United States Patent [19]

Wycklendt

[11] Patent Number: 4,568,805

[45] Date of Patent: Feb. 4, 1986

[54] J-PLATE ARC INTERRUPTION CHAMBER FOR ELECTRIC SWITCHING DEVICES

[75] Inventor: Daniel A. Wycklendt, Milwaukee, Wis.

[73] Assignee: Eaton Corporation, Cleveland, Ohio

[21] Appl. No.: 644,010

[22] Filed: Aug. 24, 1984

[51] Int. Cl.[4] ..... H01H 9/44; H01H 33/18

[52] U.S. Cl. ..... 200/147 R; 200/147 B

[58] Field of Search ..... 200/147 B, 147 R

[56] References Cited

U.S. PATENT DOCUMENTS

| | | | |
|---|---|---|---|
| 2,356,039 | 8/1944 | Ellis et al. | 200/147 |
| 2,356,040 | 8/1944 | Ellis et al. | 200/147 |
| 2,451,669 | 10/1948 | Eichenberger | 200/148 C |
| 2,632,074 | 3/1953 | Herman | 200/144 R |
| 3,024,331 | 3/1962 | Frink | 200/147 |
| 3,126,464 | 3/1964 | Stettner | 200/144 R |
| 3,201,551 | 8/1965 | Mercier | 200/147 |
| 4,080,520 | 3/1978 | Muller | 200/144 R |
| 4,375,021 | 2/1983 | Pardini et al. | 200/147 B |
| 4,429,198 | 1/1984 | Mori et al. | 200/144 R |

FOREIGN PATENT DOCUMENTS

| | | | |
|---|---|---|---|
| 1116783 | 11/1961 | Fed. Rep. of Germany | 200/147 B |
| 560257 | 3/1944 | United Kingdom | 200/147 B |

*Primary Examiner*—Robert S. Macon

*Attorney, Agent, or Firm*—C. H. Grace; W. A. Autio

[57] ABSTRACT

An arc interruption structure for an electric switching device such as a contactor having one or more J-plates (38,42,46,48) adjacent to but insulated from each contacts gap provided by stationary contacts (20,22) and a movable bridging contact (24) of the contactor whereby sub-arcs are received from the contacts gaps to the bend (38*c*) of the J-plates and move therefrom along the short limb (38*b*) of the J-plate to the extremity (38*c*) thereof, thus to be retained and extinguished within the arc interruption structure and not ejected either forwardly into the vent space or reversely back toward the contacts gap. The J-plates (38,42) may have various forms such as a reduced-width bend (38*c*) with greater width limbs (38*a*,38*b*) or a reduced-width bend (52*d*) and short limb (52*c*) with a greater width long limb (52*f*). These J-plates may be used with arc runners (22*a*,24*a*) and/or with one or more flat, arc splitter-plates (40,41,44,45) and/or an auxiliary arc bridge (30).

13 Claims, 11 Drawing Figures

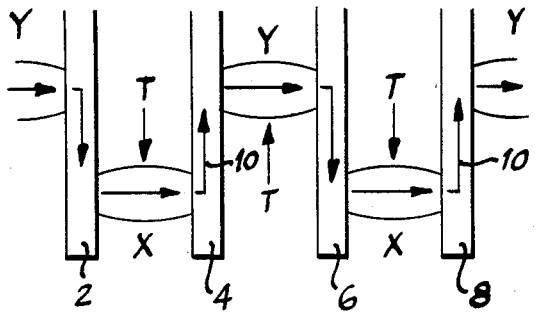
Fig. 1
PRIOR ART
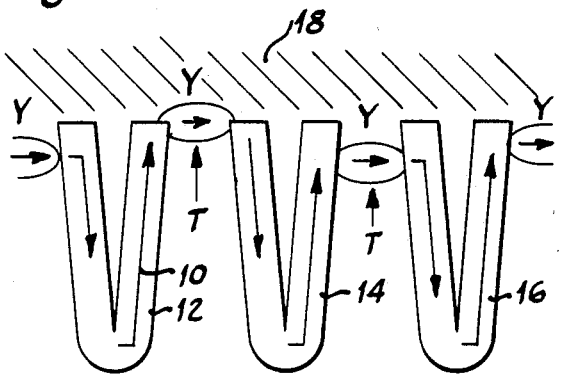
Fig. 2
PRIOR ART
Fig. 5
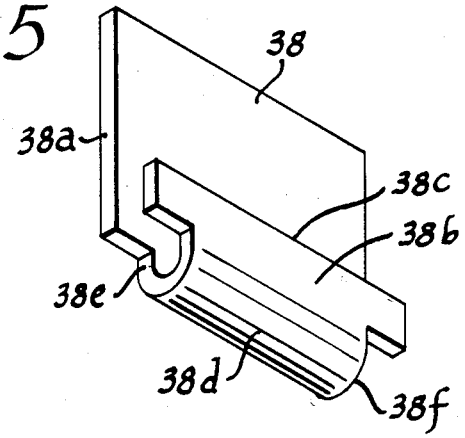

Fig. 3 PRIOR ART
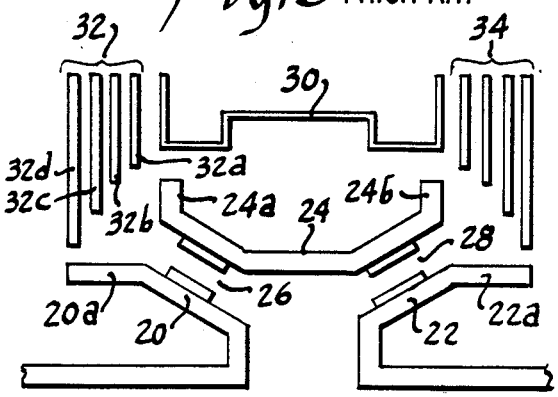
PRIOR ART Fig. 4
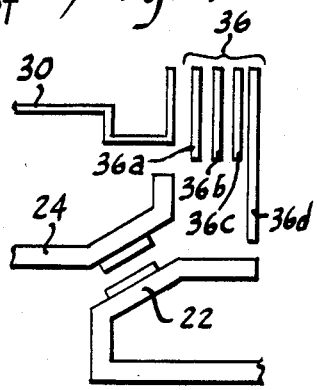
Fig. 6
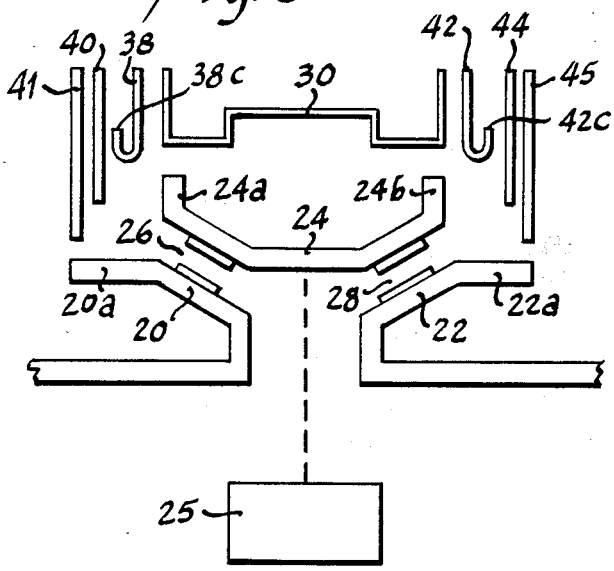
Fig. 7
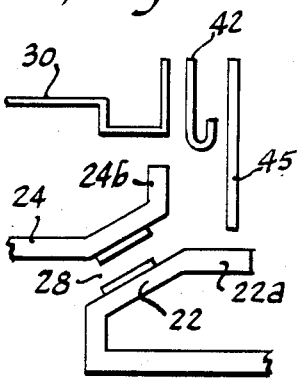

Fig. 9
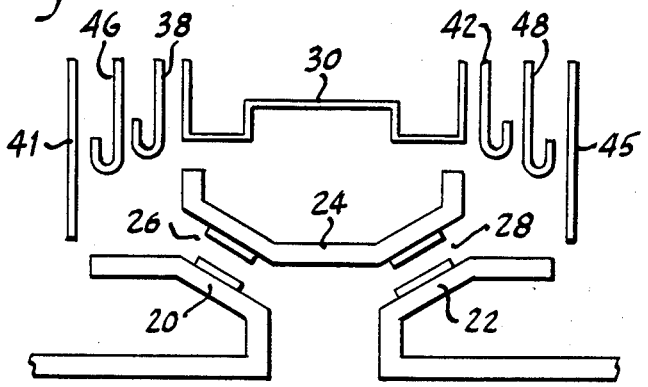
Fig. 10
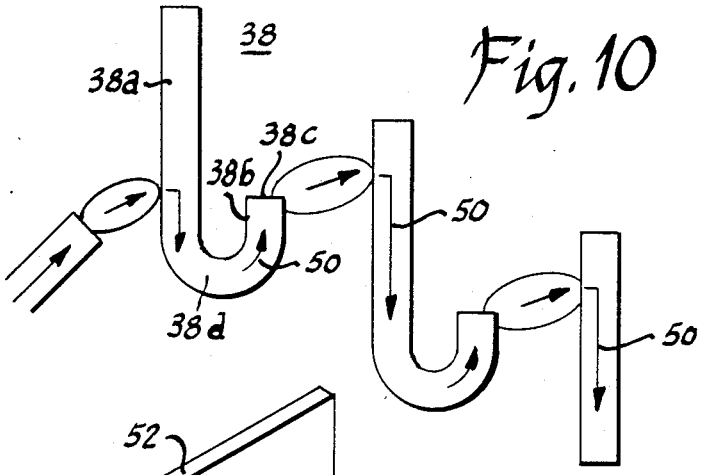
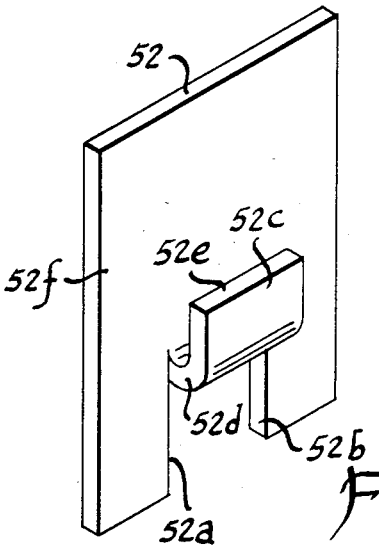
Fig. 11
Fig. 8
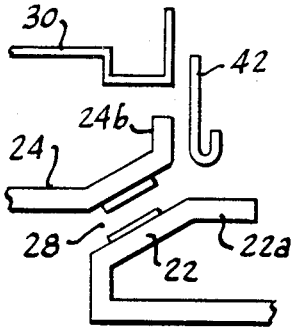

J-PLATE ARC INTERRUPTION CHAMBER FOR ELECTRIC SWITCHING DEVICES

BACKGROUND OF THE INVENTION

Arc interruption chambers for electric switching devices such as electric contactors have been known heretofore. To increase the interrupting capability of switches and contactors above levels of current and voltage that can be handled by simple contact gaps, such devices are equipped with special arc chambers which enhance arc extinction. Commonly, particularly in A.C. contactors and switches, the break-arcs are deflected into arc chutes which are provided with one or more metallic, so-called splitter-plates. These plates that are usually made of mild steel are usually flat and insulated from one another such as, for example, the plates or baffles shown in M. Muller, Pat. No. 4,080,520, dated Mar. 21, 1978, and F. P. Pardini et al patent no. 4,375,021, dated Feb. 22, 1983. Frequently, especially in contactors, these plates are somewhat remote from the contact gap or gaps as shown in the aforementioned patents. Alternatively, flat plates (not shown) which virtually embrace the contact gaps have been used in prior devices.

Magnetic forces, usually induced by the flow of the current to be interrupted, cause the break-arcs to impinge upon and penetrate the splitter-plate array in the arc interruption chamber. A buildup of pressure in front of the arc would tend to inhibit penetration of the splitter system; therefore, the splitter system is preferably more or less open (vented) at the edges opposite the arc entry edges of the plates.

Theoretically, splitter-plate systems promote current interruption by aggressive cooling of arcs and subdivision of arcs into a series of sub-arcs, partial arcs or arclets. Thus, for reliable interruption of an alternating current arc, the splitter array should (1) allow and preferably promote rapid penetration of the splitter system by the arc, and (2) not promote or allow ejection of arcs either backward toward the contact gap or forward toward the vent region. Flat splitter-plates, with straight edges or with serrated or notched edges, generally have shortcomings in either or both of the functions mentioned above. Most prior designs are troubled by unstable retention of the arcs, an effect which can be ascribed to magnetic field forces produced by currents in the plates. This action, which will hereinafter be more specifically described in connection with FIG. 1, whereby current loops are formed by irregular displacement of sub-arcs, produces forces which tend to eject the sub-arcs.

V-shaped splitter-plate structures have also been known. While these V-shaped splitter-plates inhibit ejection of sub-arcs in one direction, this V-shaped structure, however, promotes rapid ejection of sub-arcs into the vent space. This shortcoming permits a reuniting of the sub-arcs in the vent space, thus forming a single arc, or a lesser number of sub-arcs, with substantially reduced interrupting capability. Furthermore, whether the vent space is provided or not, the arcs are forceably pressed to insulation surfaces of the arc extinguishing chamber, thus aggravating thermal deterioration of the chamber.

It has, therefore been found desirable to provide improved arc extinguishing chamber structures including improved splitter-plate configurations and related splitter-plate arrays that overcome the aforementioned disadvantages and shortcomings.

SUMMARY OF THE INVENTION

An object of the invention is to provide an improved arc interruption chamber for electric switching devices.

A more specific object of the invention is to provide an arc interruption chamber with an improved insulated arc splitter-plate shape that will enhance retention of the arc within the arc interruption chamber and inhibit ejection thereof into the forward vent space as well as in the reverse direction toward the contact gap.

Another specific object of the invention is to provide an arc interruption chamber for electric switching devices with an improved J-shaped arc splitter-plate.

Another specific object of the invention is to provide an arc interruption chamber for an electrical switching device with an improved configuration for the arc splitter-plates.

Other objects and advantages of the invention will hereinafter appear.

These and other objects and advantages of the invention are accomplished by providing in an electrical circuit switching device having contact means comprising a stationary contact and a movable contact and means for causing said movable contact to engage and disengage said stationary contact and the voltage of said circuit being high such that an electrical arc is formed in the contacts gap as said movable contact disengages from said stationary contact, the improvement comprising an arc interruption structure adjacent said contacts gap comprising an arc runner associated with said stationary contact, an insulated conductive member for receiving said arc from said contacts gap and having a generally J-shaped configuration comprising a long limb and a relatively short limb and a reverse bend therebetween with said reverse bend receiving the arc from said contacts gap and causing generally faster and less erratic penetration of the arc into said arc interruption structure, and said short limb facing in a direction such that a sub-arc runs from said bend along said short limb to the extremity of said short limb to cause retention and extinguishing of the arc within said structure more reliably and persistently and to prevent the arc from traversing said arc interruption chamber into the forward vent space therebeyond or from being ejected in the reverse direction toward said contacts gap.

BRIEF DESCRIPTION OF THE DRAWINGS

FIG. 1 shows schematically a prior art arc interruption chamber wherein the splitter-plates are flat and the sub-arcs travel upwardly therealong.

FIG. 2 shows a prior art V-shaped splitter-plate construction which inhibits ejection of sub-arcs in one direction.

FIG. 3 is a schematic illustration of contactor contacts and arc interruption chambers having arrays of flat splitter-plates of varying length for a bridging contact type of contactor.

FIG. 4 is a schematic illustration similar to the right half of FIG. 3 showing a contactor arc extinguishing chamber and contacts wherein the splitter-plates are flat and of equal length, except for the outermost or end plate.

FIG. 5 is an isometric view of one form of arc splitter-plate or arc control plate that can be used in the present invention.

FIG. 6 is a schematic illustration of bridging contacts together with arc runners and arc interruption chambers using J-plates and pairs of flat splitter-plates in accordance with the invention.

FIG. 7 is a schematic illustration of one half of the device of FIG. 6 showing use of a J-plate with one flat splitter-plate together with the arc runners.

FIG. 8 is a schematic illustration of a modification of the device of FIG. 7 showing use of a single J-plate together with the arc runners but without any flat arc splitter-plates.

FIG. 9 is a modification of the device of FIG. 6 showing use of a plurality of J-plates and one flat arc splitter-plate on each side of the bridging contacts together with the arc runners.

FIG. 10 is a schematic illustration in a qualitative manner of the arc behavior which the plurality of J-shaped plates of FIG. 9 provide.

FIG. 11 is an isometric illustration of a modification of the J-plate which can be used in the invention.

DESCRIPTION OF THE PREFERRED EMBODIMENTS

Referring to FIG. 1, there is shown a prior art arc extinguishing arrangement that includes flat arc splitter-plates 2, 4, 6 and 8 having either straight edges or serrated or notched edges at the lower or arc-entry end of the plates. This FIG. 1 illustrates how prior art arc extinguishing arrangements are handicapped by unstable retention of the arcs X and Y, an effect which can be ascribed to magnetic field forces produced by currents 10 in the plates. This action is illustrated in FIG. 1 which shows how current loops 10, formed by irregular displacement of sub-arcs X and Y, produce thrust forces T which tend to eject the sub-arcs. These current loops produce downward thrust force on sub-arcs X and produce upward thrust force on sub-arcs Y as indicated by the arrows marked T. As will be apparent, the direction of this thrust force may be described in accordance with Fleming's left-hand rule which defines the direction of the thrust force relative to the direction of the magnetic flux and the current. These thrust forces have a tendency to cause the sub-arcs Y to be ejected upwardly into the vent space while sub-arcs X are ejected downwardly toward the contacts gap. Ejection of sub-arcs of type X toward the contacts gap reduces the effectiveness of a portion of the splitter-plate system and also increases the tendency of arcs to reignite in the vulnerable contact gap. Furthermore, whether the preferred vent space is provided or not, the arcs are forcibly pressed to insulation surfaces of the chamber, thus aggravating thermal deterioration of the chamber.

FIG. 2 illustrates another prior art version of arc splitter-plates of V-shaped construction which inhibit ejection of sub-arcs in the downward direction because this construction provides no sub-arcs similar to sub-arcs X in FIG. 1. This V-shaped construction, however, promotes rapid ejection of sub-arcs upwardly into the typically provided vent space. More specifically, V-shaped splitter-plates 12, 14 and 16 have sub-arcs Y formed therebetween and thrust forces T developed by currents 10 in the plates cause sub-arcs Y to be ejected into the preferred vent space 18 where they can reunite in a single arc or a reduced number of sub-arcs, in either case, with substantially reduced interruption capability. Furthermore, whether the preferred vent space is provided or not, the sub-arcs are forcibly pressed to insulation surfaces which may be present at the top of the chamber, thus aggravating thermal deterioration of the chamber.

FIGS. 3 and 4 show two different versions of prior art contacts arc runners and arc extinguishing chamber constructions. In FIG. 3, a pair of stationary contacts 20 and 22 are bridged by a movable contact 24. The arc extinguishing structure comprises two pairs of flared arc runners 20*a*, 24*a* and 22*a*, 24*b*, an auxiliary arc bridge 30 and two sets of arc splitter-plates 32 and 34, one such set of splitter-plates being for each opening gap 26 and 28 of the bridging contacts. In the FIG. 3 version, the splitter-plates are flat and of varying length so that the plate 32*a* adjacent auxiliary arc bridge 30 is the shortest and the plates 32*b*, 32*c* and 32*d* are progressively longer with plate 32*d* exending near arc runner 20*a*. The FIG. 4 version is similar to that in FIG. 3 except that inner arc splitter-plates 36*a–c* are of equal length vertically while outer plate 36*d* is longer as in FIG. 3, plates 36*a–c* being generally similar to what is shown in the aforementioned M. Muller Pat. No. 4,080,520.

An essential element of this invention is an arc splitter-plate which has a short bend in that edge which will intercept the arc loop. Such a plate, which may be referred to as a J-plate, is shown in FIG. 5. One or more of these J-plates may be used alone or in conjunction with one or more flat plates to provide an arc interruption structure such as is shown in FIGS. 6, 7, 8 and 9. As shown in FIG. 5, this J-plate 38 is provided with a long limb 38*a* and a relatively shorter limb 38*b* having an extremity 38*c* with a 180 degree bend 38*d* therebetween. A pair of notches or cut-outs 38*e* and 38*f* are formed in opposite edges of the J-plate at bend 38*d* so that the major portion of long limb 38*a* is wider than bend 38*d* and the upper end portion of shorter limb 38*b* is of equal width as longer limb 38*a* to facilitate assembly.

FIG. 6 shows a first version of arc extinguishing structure using the J-plate of FIG. 5. As shown in FIG. 6, a pair of stationary contacts 20 and 22 are bridged by a movable bridging contact 24 which is operated by actuating means 25. This version of FIG. 6 is also provided with two pairs of arc runners 20*a*, 24*a* and 22*a*, 24*b* at opposite sides and a central auxiliary arc bridge 30 similar to those shown in FIGS. 3 and 4. For the left contact gap 26, there is provided one J-plate 38 and two flat plates 40 and 41. And for the right contact gap 28 there is provided one J-plate 42 and two flat plates 44 and 45. It will be noted that J-plates 38 and 42 are turned outwardly, that is, the shorter limb of each thereof faces outwardly toward flat plates 40 and 44, respectively, whereas the longer limbs thereof face inwardly. Mild steel is preferably used as the arc splitter-plate material not only for economy but also because its magnetic property moderately assists movement of the arc into the plates which are insulated from one another. When contact 24 opens in response to actuator 25 to provide two contact gaps 26 and 28 on opposite sides thereof, the arcs formed therebetween move out into the arc splitter structures and are each broken into a plurality of sub-arcs between the arc runner 24*a* auxiliary arc bridge 30, splitter-plates 40 and 41 and arc runner 20*a* on the left side and between arc runner 24*b*, auxiliary arc-bridge 30, splitter-plates 44 and 45 and arc runner 22*a* on the right side. The sub-arc between splitter-plates 38 and 40 moves up to the upper end 38*c* of the short limb of J-plate 38 and stops there so that it will be extinguished and is not ejected upwardly into the vent space. In a similar manner, the sub-arc between splitter-plates 42 and 44 on the right-hand side moves up to the upper end 42*c* of the shorter limb of J-plate 42 and stops there so that it will not be ejected any further upwardly.

FIG. 7 shows a modification of the structure of FIG. 6 wherein the flat splitter-plates 40 and 44 have been left out, thus using only a single J-plate 42 between flat plate 45 and auxiliary arc bridge 30 on the right-hand side and similarly on the left-hand side (not shown).

FIG. 8 shows a modification of the structure of FIG. 7 wherein flat arc splitter-plates 41 and 45 have been left out, thus using only J-plate 42 between arc runner 22*a* and auxiliary arc bridge 30 and/or arc runner 24*b* on the right-hand side and similarly on the left-hand side (not shown) for double-break contacts. For single-break contacts, the structure would be essentially similar to what is shown in FIG. 8, or FIG. 7 or the right side of FIG. 6 or 9.

FIG. 9 shows another modification of FIG. 6 wherein flat splitter-plate 40 has been replaced by another J-plate 46 and flat plate 44 has been replaced by another J-plate 48 so as to have two J-plates and one flat splitter-plate for each of the contact gaps 26 and 28.

FIG. 10 illustrates in a qualitative manner the arc behavior which the J-shaped plates provide. As shown therein, the current paths 50 in the J-plates are such that the magnetic forces will tend to urge the sub-arcs toward the interior of the plate array. Current paths similar to those which would eject sub-arcs in the reverse direction in an exclusively flat plate array such as shown in FIG. 1 do not occur in FIG. 10. On the other hand, complete traversal of the splitter array by sub-arcs is prevented by the abrupt termination of the short limb 38*b* at its extremity 38*c*. Therefore, reuniting of the sub-arcs in the forward vent space, if it is present, is inhibited. Furthermore, the sub-arcs are not forced into intimate contact with insulation surfaces, thus reducing thermal deterioration of the arc chamber. Instead, the sub-arcs remain between the J-plate's short limb extremity 38*c* and the adjacent long limb and are extinguished therein as generally illustrated in FIG. 10.

In actual tests, the splitter arrays containing J-plates as disclosed herein were constructed and compared to arrays of flat plates as shown in FIGS. 3 and 4. In interrupting tests at high current and high voltage values, single phase, the construction shown in FIG. 6 greatly out-performed the construction shown in FIGS. 3 and 4. In particular, the construction shown in FIGS. 3 and 4 exhibited several multiple reignitions of the arcs. Such events aggravate deterioration of the arc chambers and, moreover, are symptomatic of a high probability of catastrophic failure to interrupt. On the other hand, the construction shown in FIG. 6, which includes J-plates, exhibited complete freedom from multiple reignitions in a large number of tests. The construction shown in FIG. 7 having only one J-plate and only one flat plate in each chamber exhibited similar freedom from multiple reignition when tested at high voltage. Also, from oscillograms of arc voltages, it was evident that the J-plate arrays produced generally faster and less erratic penetration of the arcs into the splitters than arrays of exclusively flat plates. More importantly, the arc voltages indicated that retention of the arcs in arrays containing J-plates was far more reliable and persistent than arrays of exclusively flat plates. These qualities promote early, reliable arc interruption.

While several modifications of the invention have been illustrated and described, showing positions of the J-plate and ordering of J-plates relative to the flat plates which are preferred, it will be apparent that other arrangements are possible. While the several versions of the invention illustrated and described show a number of features in addition to the J-plates, it will be apparent that all of such features are not necessary in each different version of a contactor or switching device. For example, flat splitter-plates are deemed unessential. The double-break bridge contact is not deemed essential since the J-plate structure and its benefits would, for example, be applicable to a rotary, single-break switching device. The auxiliary arc bridge is deemed to be unessential since the benefits of the J-plate structure can be attained in devices not having the same. Also, it will be apparent that the essential principle of the J-plate interruption structure, namely an abruptly terminated bend at an edge that intercepts the arc, can be implemented in plates which differ in design from that shown in FIG. 5. For example, it seems possible to extend the J-plate principle to plates similar to that shown in FIG. 11 which might be preferred for circuit breakers or contactors of high arc breaking capability. As shown in FIG. 11, J-plate 52 has a generally rectangular shape with the lower center one-third portion being sheered vertically in spaced location 52*a* and 52*b* and the center one-third portion 52*c* being bent upwardly at bend 52*d* to provide a narrow short limb 52*c* having an extremity 52*e* and a long limb 52*f*.

The J-plate arc chambers are capable of producing arc voltages characterized by rapid development to high levels for the space involved and good stability. These characteristics are particularly desired for switching devices which utilize arc voltage to actively force arc currents toward zero. This action is frequently desired in A.C. circuit breakers but it is essential to current interruption in common forms of D.C. contactors and circuit interruptors. Accordingly, the invention is capable of successfully functioning as a D.C. contactor and the aforementioned test results demonstrated a D.C. power interruption capability roughly equivalent to the A.C. capability.

While the apparatus hereinbefore described is effectively adapted to fulfill the objects stated, it is to be understood that the invention is not intended to be confined to the particular preferred embodiment of J-plate arc interruption chamber for electric switching devices disclosed, inasmuch as it is susceptible of various modifications without departing from the scope of the appended claims.

I claim:

1. In an electrical switching device having contact means comprising a stationary contact and a movable contact, and means for causing said movable contact to engage and disengage said stationary contact, and the voltage of said circuit being high such that an electrical arc is formed in the contacts gap as said movable contact disengages from said stationary contact, the improvement comprising:

an arc interruption structure adjacent said contacts gap comprising:

an arc runner associated with said stationary contact;

an insulated conductive member for receiving said arc from said contacts gap and having a generally J-shaped configuration comprising a long substantially straight limb and a relatively short limb less than half the length of said long limb and a reverse bend therebetween with said reverse bend receiving the arc from said contacts gap and causing generally faster and less erratic penetration of the arc into said arc interruption structure;

said short limb facing in a direction such that a sub-arc runs from said bend along said short limb to the extremity of said short limb to cause retention and extinguishing of the arc within said structure more reliably and persistently and to prevent the arc from traversing said arc interruption structure therebeyond or into contact with any insulating surfaces or from being ejected in the reverse direction toward said contacts gap.

2. The electrical switching device claimed in claim 1, wherein:

said arc runner is an extension of said stationary contact.

3. The electrical switching device claimed in claim 2, wherein:

said short limb faces away from said movable contact such that said sub-arc runs between said arc runner and said J-shaped member from said bend along said short limb to the extremity of the latter.

4. The electrical switching device claimed in claim 1, wherein:

said J-shaped conductive member has the form of a flat rectangular plate bent back near one end so that said long limb thereof is planar to said bend and said short limb is much shorter than said long limb and is planar to said bend;

and a pair of notches at the opposite edges of said member at said bend reducing the width of said member at said bend so that both said long limb and said short limb are wider than said bend.

5. The electrical switching device claimed in claim 1, wherein:

said J-shaped conductive member has the form of a flat rectangular plate cut from one end at spaced positions a predetermined distance inwardly and the center portion between said cuts being bent so as to provide said short limb parallel with the remainder of said plate which forms said long limb thereby to provide two spaced extensions beyond said bend as a continuation of said long limb.

6. In an electrical switching device having contact means comprising a stationary contact and a movable contact, and means for causing said movable contact to engage and disengage said stationary contact, and the voltage and current of said circuit being high such that an electrical arc is formed in the contact gap as said movable contact disengages from said stationary contact, the improvement comprising:

an arc interruption structure adjacent said contacts gap having a forward vent space comprising:

an insulated electrically conductive magnetic member for receiving said arc from said contacts gap and having a generally J-shaped configuration comprising a long substantially straight limb and a parallel relatively short limb less than half the length of said long limb and a reverse bend therebetween with said reverse bend being closest the contacts gap to receive the arc therefrom and causing generally faster and less erratic penetration of the arc into said arc interruption structure;

additional substantially straight electrically conductive means spaced alongside of and generally parallel with said J-shaped member for receiving a sub-arc between itself and said J-shaped member;

and said short limb facing in a direction such that said sub-arc runs from said bend along said short limb to the extremity of said short limb to cause retention of such sub-arc within said arc interruption structure more reliably and persistently thereby to prevent such sub-arc from traversing said arc interruption structure into the forward vent space therebeyond or into contact with insulation surfaces thereat or from being ejected in the reverse direction toward said contacts gap.

7. The electrical switching device claimed in claim 6, wherein:

said additional electrically conductive means is a generally straight flat arc splitter-plate spaced from said short limb side of said J-shaped member whereby said sub-arc moves between said plate and said short limb.

8. The electrical switching device claimed in claim 6, wherein:

said additional electrically conductive means is a generally flat plate portion spaced from said long limb side of said J-shaped member.

9. The electrical switching device claimed in claim 6 wherein:

said contact means comprises a pair of stationary contacts and said movable contact comprises a bridging contact for electrically connecting and disconnecting said stationary contacts;

and said arc interruption structure comprises a pair of said J-shaped electrically conductive magnetic members, one for each of the contacts gaps provided when said movable bridging contact disengages said stationary contacts, and a pair of said additional electrically conductive means, one for each of said contacts gaps.

10. The electrical switching device claimed in claim 9, wherein:

said short limb sides of said J-shaped members face outwardly;

and said pair of said additional electrically conductive means are spaced outwardly from said short limb sides of the respective J-shaped members.

11. The electrical switching device claimed in claim 10, wherein:

said stationary contacts and said movable bridging contact are provided with arc runner extensions with the extensions of each pair thereof diverging toward the respective arc interruption structures for guiding the arcs thereto.

12. The electrical switching device claimed in claim 9, wherein:

said long limbs of said J-shaped members face inwardly;

and said additional electrically conductive means comprises an insulated auxiliary arc bridge having right-angled end portions in spaced relation to the inwardly facing long limb sides of the respective J-shaped members.

13. The electrical switching device claimed in claim 9, wherein:

said short limbs of said J-shaped members face outwardly;

and said pair of said additional electrically conductive means comprise a pair of straight insulated arc splitter-plates in spaced relation to short limb sides of said J-shaped members.

* * * * *